US010577169B2

(12) United States Patent
Bodet et al.

(10) Patent No.: US 10,577,169 B2
(45) Date of Patent: Mar. 3, 2020

(54) DISPENSING HEAD FOR AEROSOL CONTAINER

(71) Applicant: LINDAL FRANCE SAS, Briey (FR)

(72) Inventors: Hervé Bodet, Verdun (FR); Dominique Fournet, Belleville sur Meuse (FR)

(73) Assignee: LINDAL FRANCE SAS, Val-de-Briey (FR)

( * ) Notice: Subject to any disclaimer, the term of this patent is extended or adjusted under 35 U.S.C. 154(b) by 103 days.

(21) Appl. No.: 15/770,282

(22) PCT Filed: Oct. 12, 2016

(86) PCT No.: PCT/EP2016/074493

§ 371 (c)(1),
(2) Date: Apr. 23, 2018

(87) PCT Pub. No.: WO2017/067835

PCT Pub. Date: Apr. 27, 2017

(65) Prior Publication Data

US 2018/0305111 A1 Oct. 25, 2018

(30) Foreign Application Priority Data

Oct. 21, 2015 (FR) ..... 15 60052

(51) Int. Cl.
*B65D 83/22* (2006.01)
*B65D 83/20* (2006.01)

(52) U.S. Cl.
CPC ..... *B65D 83/22* (2013.01); *B65D 83/205* (2013.01)

(58) Field of Classification Search
CPC ..... B65D 83/22; B65D 83/56; B65D 83/205; B05B 11/3059
(Continued)

(56) References Cited

U.S. PATENT DOCUMENTS 3,050,219 A * 8/1962 Sagarin ..... B65D 83/206 222/549
3,429,483 A 2/1969 Micallef
(Continued)

FOREIGN PATENT DOCUMENTS

WO 2007/022422 A2 2/2007

OTHER PUBLICATIONS

International Search Report and Written Opinion dated Jan. 13, 2017 issued in corresponding application No. PCT/EP2016/074493; w/ English partial translation and partial machine translation (18 pages).

*Primary Examiner* — Nicholas J. Weiss
(74) *Attorney, Agent, or Firm* — Seckell IP, PLLC

(57) ABSTRACT

A dispensing head for an aerosol container includes a base ring, a transfer conduit with a tip (231) intended to cooperate with the stem of a valve when the dispensing head is mounted on an aerosol container, a push button rotatable relative to the base ring, a blocking member pivotable between a blocking position and an unblocking position, and provided with a bearing surface (312), which is placed in the movement path of the tip (231) towards the valve stem is in the blocking position, and which is outside the movement path of the tip (231) towards the valve stem in the unblocking position, and guiding means (33, 313) for placing the blocking member in the blocking position when the push button is in the locked position and for placing the blocking member in the unblocking position when the push button is in the unlocked position.

20 Claims, 4 Drawing Sheets

Figure 1:
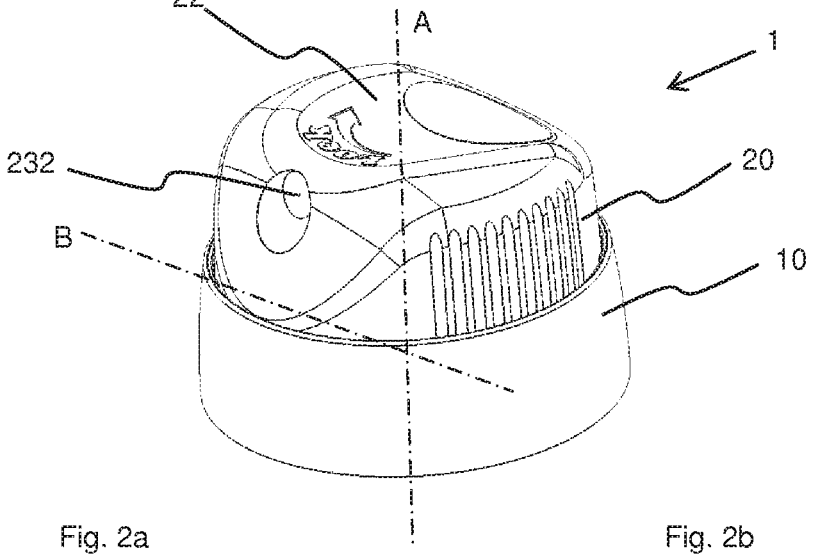

(58) Field of Classification Search
USPC ..... 222/402.11
See application file for complete search history.

(56) References Cited

U.S. PATENT DOCUMENTS

| | | | | | |
|---|---|---|---|---|---|
| 3,827,605 | A * | 8/1974 | Knickerbocker | ... | B05B 11/3059 222/153.13 |
| 3,924,782 | A * | 12/1975 | Starrett | ..... | B65D 83/205 222/402.11 |
| 4,418,842 | A * | 12/1983 | Di Loreto | ..... | B65D 83/205 222/153.11 |
| 7,530,476 | B2 * | 5/2009 | Downey | ..... | B65D 83/205 222/153.11 |
| 2007/0039979 | A1 | 2/2007 | Strand et al. | | |
| 2007/0235474 | A1 | 10/2007 | Downey et al. | | |
| 2008/0164285 | A1 | 7/2008 | Hygema | | |
| 2009/0145928 | A1 | 6/2009 | De Laforcade | | |

* cited by examiner

DISPENSING HEAD FOR AEROSOL CONTAINER

The invention concerns a dispensing head for an aerosol container provided with a valve equipped with a valve stem, the dispensing head comprising a base ring, a push button rotatable relative to the base ring about an axis of rotation between a locked position and an unlocked position, a transfer conduit provided with a tip intended to cooperate with the stem of a valve when the dispensing head is mounted on an aerosol container provided with such a valve, and blocking means movable between a blocking position in which the tip cannot cooperate with the valve stem and an unblocking position in which the tip can cooperate with the valve stem to open the valve. In these dispensing heads, the push button can be moved relative to the base ring between a high position in which the tip of the transfer conduit is at a distance from the valve stem and a low position in which the tip cooperates with the stem to open the valve.

Such dispensing heads are commonly used in aerosol containers. When the push button is in the locked position, it is not possible by pressing it to move it downwards and to actuate the valve, because the blocking means prevent the push button from reaching the low position. In contrast, when the push button is in the unlocked position, the blocking means no longer impede the downward movement of the push button: it is then possible to actuate the valve and to take the product contained in the container.

WO 2007/022422 discloses a dispensing head according to the preamble. The blocking means are constituted by a plurality of radial ribs formed inside the base ring and by an identical number of notches formed in the lower edge of the push button. As long as the notches are not aligned with the ribs, the lower edge of the push button bears on the ribs and it is not possible to push the push button towards the valve to actuate it. Conversely, when the notches are aligned with the ribs, it is possible to move the push button downward and to actuate the valve. Such a dispensing head requires only a few parts and is therefore well suited to mass use. However, the proposed solution has the disadvantage that the push button is retained in the upper position only by its periphery. It is therefore essential that its structure is sufficiently rigid so that its top wall can not deform towards the valve under the effect of the pressure of a finger while the push button is in the locked position.

The object of the invention is to improve the distribution heads of the preamble to avoid the disadvantages mentioned.

According to the invention, the blocking means comprise a blocking member pivotable between a blocking position and an unblocking position, the blocking member being provided with a bearing surface, which bearing surface is placed in the movement path of the tip of the transfer conduit towards the valve stem when the blocking member is in the blocking position, and which bearing surface is outside the movement path of the tip towards the valve stem when the blocking member is in the unblocking position. The blocking means also comprise guiding means for placing the blocking member in the blocking position when the push button is in the locked position and for placing the blocking member in the unblocking position when the push button is in the unlocked position. The blocking means of the invention have the advantage of being directly interposed between the tip and the valve. Even if the top wall of the push button were to deform while the push button is in the locked position, this would have no consequence, because the tip would come to abut against the bearing surface of the blocking means and could not come in contact with the valve.

In a simple manner, the blocking means can be constituted by a guide pin and a guide slot into which the free end of the guide pin penetrates, one of these two parts, preferably the guide pin, being fixed in the push button while the other, preferably the guide slot, is fixed on the blocking member. Thus, when the push button pivots from one position to the other, it drives with it the guide pin which in turn drives the blocking member. Thanks to the slot, the connection between the pin and the blocking member is not fixed. It is therefore not necessary that the blocking member and the push button pivot about the same axis.

The blocking member is preferably constituted by a vertical wall having a notch, the upper edge of the vertical wall constituting the bearing surface. Thus, in the blocking position, the portion surrounding the notch is in the path of the tip towards the valve. Conversely, in the unblocking position, the notch is aligned with the tip so that no obstacle is in its path towards the valve.

Preferably, the transfer conduit is an integral part of the push button.

The blocking member and the guiding means can be designed so that a rotation of the push button relative to the base ring causes a pivoting of the blocking member between the blocking position and the unblocking position.

The blocking member is preferably mobile relative to the base ring. It can be fixed to the base ring via a hinge forming an axis of rotation parallel to the axis of rotation of the push button relative to the base ring. This hinge is preferably a film hinge. The hinge can be fixed to a fixing wall forming an integral part of the base ring.

In order to facilitate the return of the push button into the high position, it is preferable to provide disengagement means for disengaging the tip from the stem of a valve when the button is moved from the unlocked position to the locked position.

Similarly, stops can be provided on the base ring or on the push button, which cooperate with a stop finger placed on the push button or on the base ring to limit the rotational movement of the push button relative to the base ring between the locked position and the unlocked position.

Audible information means can be provided for emitting one or more sounds, such as one or more clicks, when the push button is moved from the locked position to the unlocked position or vice versa.

Figure 2A:
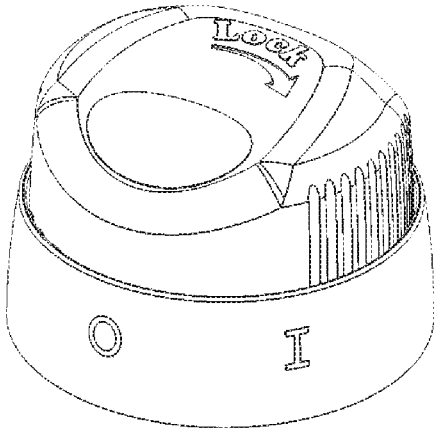
Figure 2B:
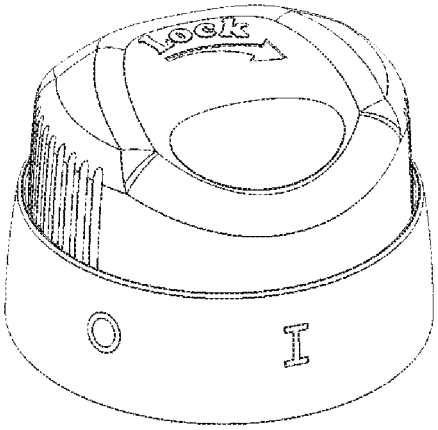

The invention is described in more detail with the aid of the following figures:

FIG. 1: Front perspective view of the device of the invention in the closed position;

FIG. 2: Rear perspective view of the device of the invention (a) in the locked position and (b) in the unlocked position;

First Variant Embodiment

Figure 3:
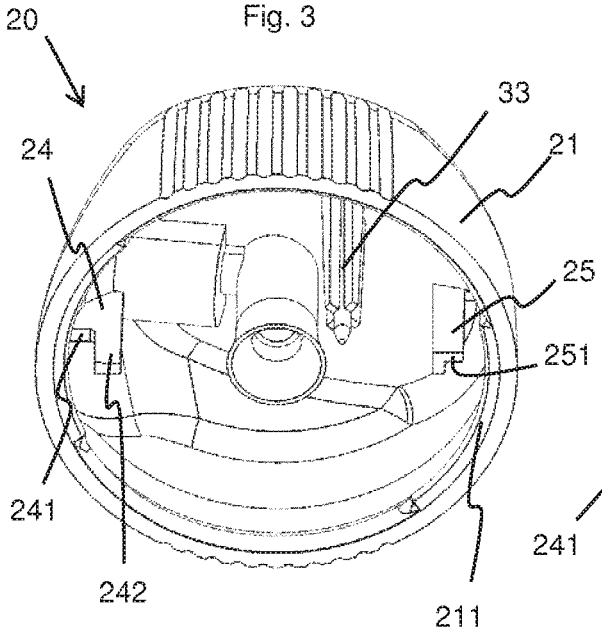
Figure 4:
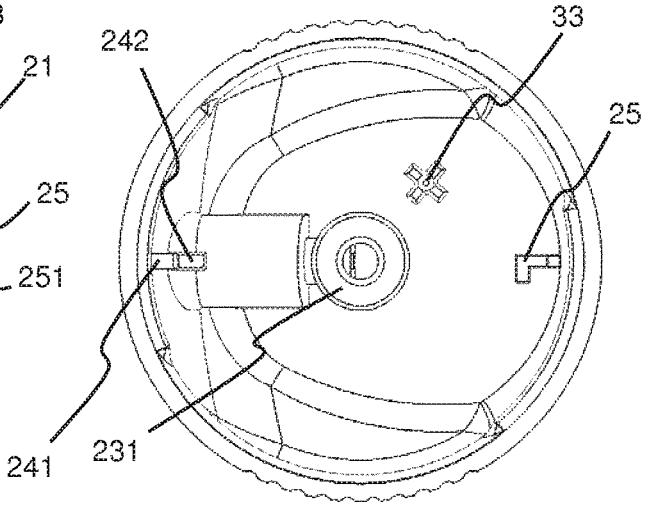
Figure 7A:
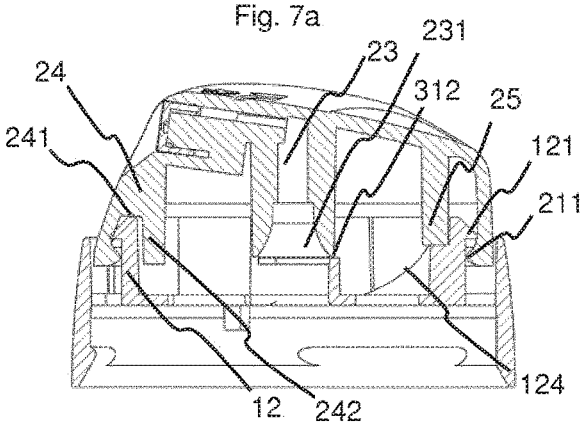
Figure 8A:
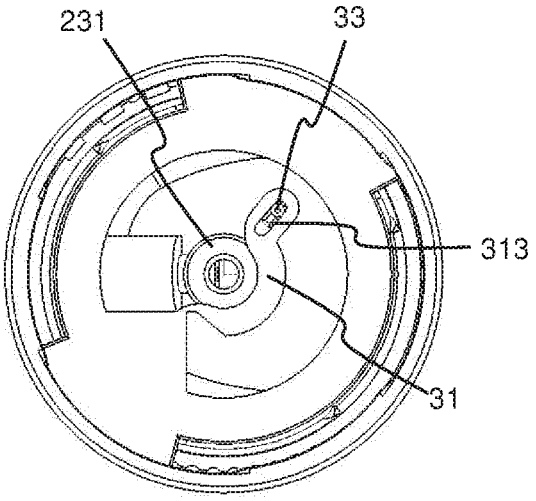
Figure 8B:
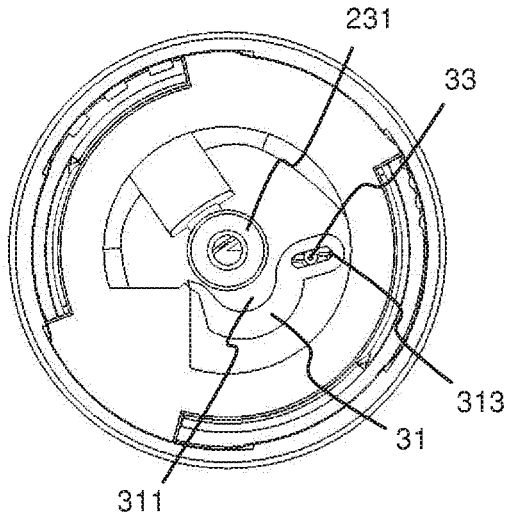
Figure 9A:
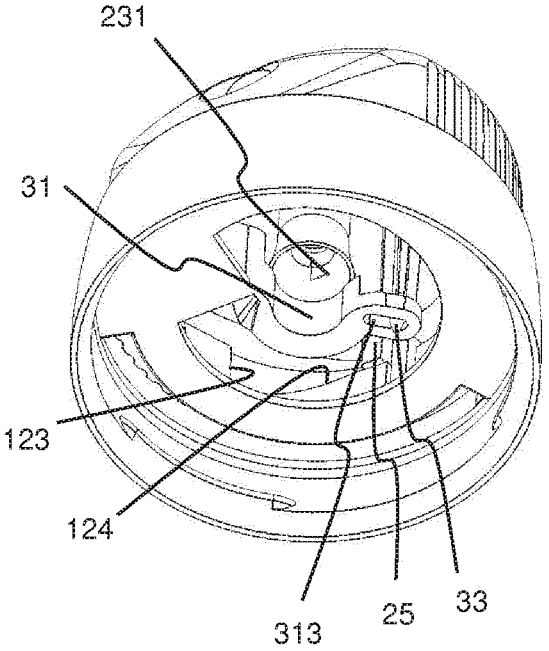
Figure 9B:
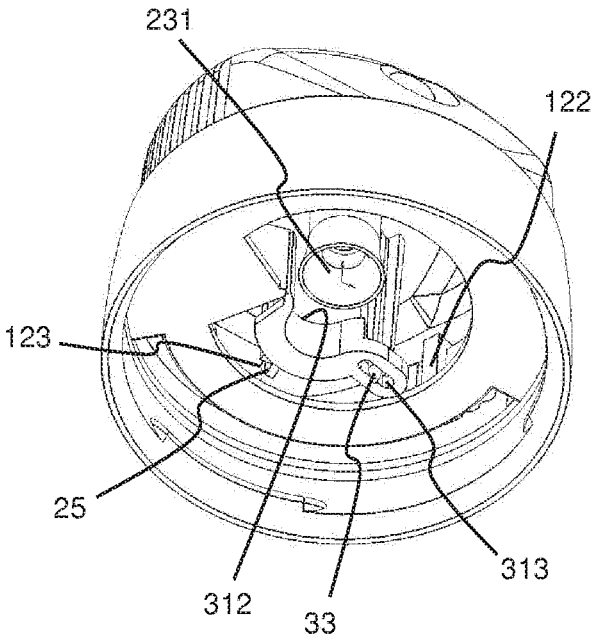

FIG. 3: Perspective view of the bottom of the push button;

FIG. 4: Bottom view of the push button of FIG. 3;

FIG. 5: Top view of the base ring (a) in the locked position and (b) in the unlocked position;

FIG. 6: Perspective view of the base ring of FIG. 5 (a) in the locked position and (b) in the unlocked position;

FIG. 7: Cross-sectional view through the device of the invention (a) in the locked position and (b) in the unlocked position;

FIG. 8: Bottom view of the device of the invention (a) in the locked position and (b) in the unlocked position;

FIG. 9: Bottom perspective view of the device of the invention (a) in the locked position and (b) in the unlocked position;

Second Variant Embodiment

Figure 10:
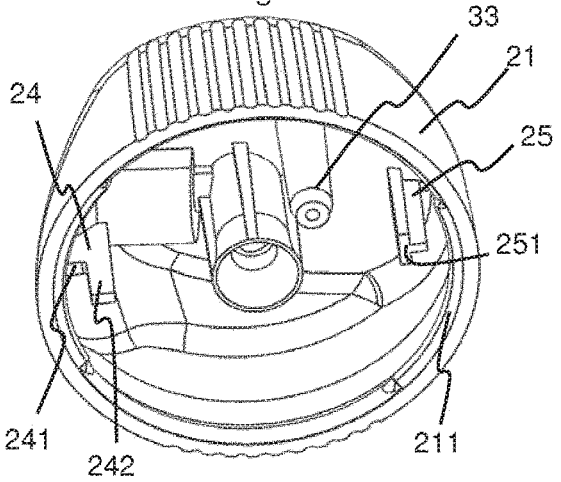
Figure 11:
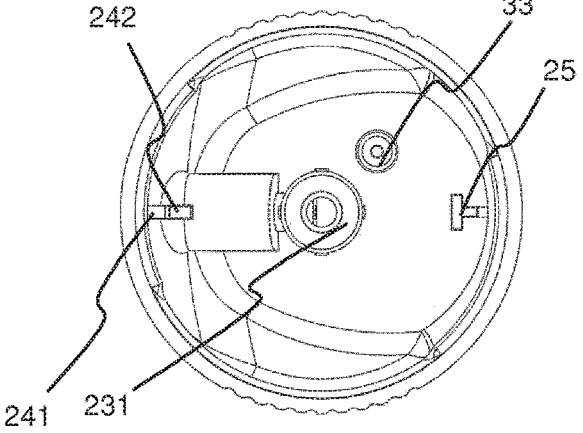
Figure 12A:
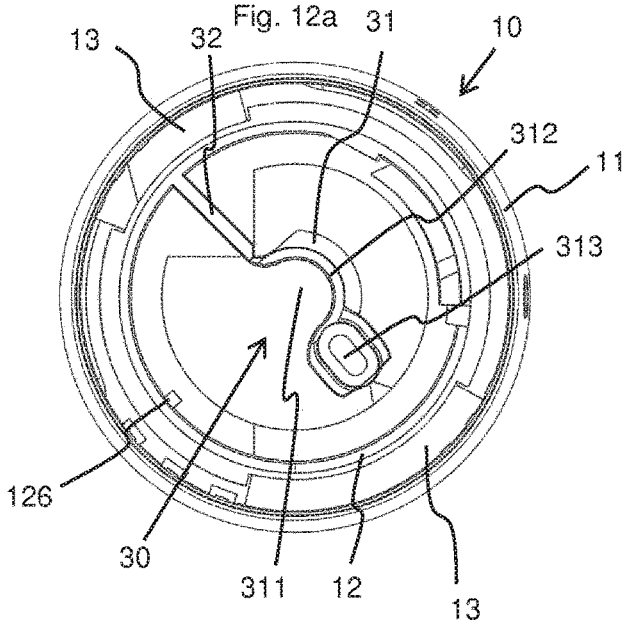
Figure 12B:
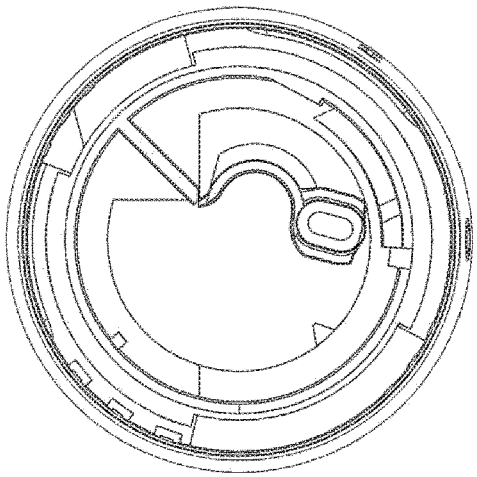
Figure 13A:
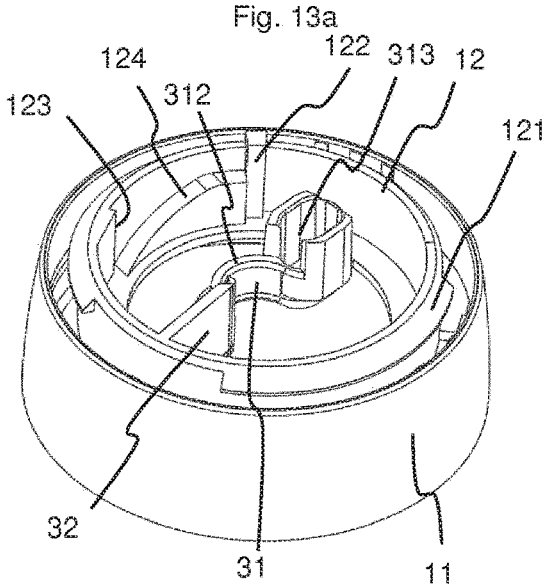
Figure 13B:
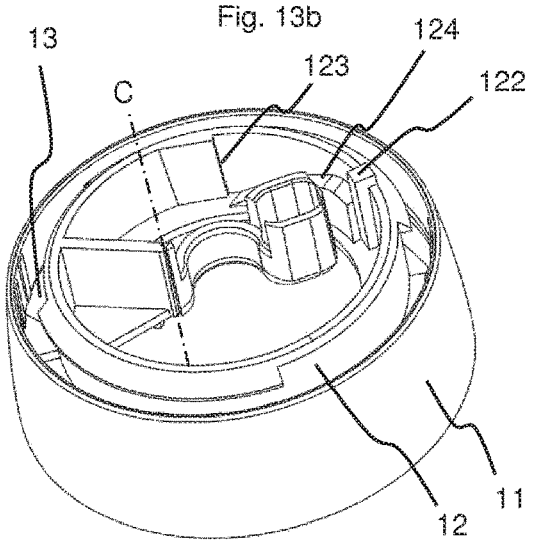

FIG. 10: Perspective view of the bottom of the push button;

FIG. 11: Bottom view of the push button of FIG. 10;

FIG. 12: Top view of the base ring (a) in the locked position and (b) in the unlocked position;

FIG. 13: Perspective view of the base ring of FIG. 12 (a) in the locked position and (b) in the unlocked position.

The invention concerns a dispensing head (1) for an aerosol container. This head is used to actuate the stem of the valve of an aerosol container.

The dispensing head is composed of two main elements: a base ring (10) and a push button (20) housed mobile on or in the base ring (10). The base ring and the push button have a certain symmetry of rotation about an axis of symmetry (A). The push button (20) is rotatable relative to the base ring about an axis of rotation coinciding with the axis of symmetry (A). Blocking means (30) mobile between a blocking position and an unblocking position are provided to prevent actuation of the valve when they are in the blocking position. Two embodiments are shown in the figures. The same references are used for both variants.

The base ring (10) is constituted by two concentric annular rings (11, 12) interconnected by connecting walls (13) that are regularly distributed. The outer annular ring (11) is provided with fixing means for fixing the base ring (10) on the aerosol container, preferably at the junction between the housing and the cup of the valve. These fixing means are constituted by a bulge (14) placed in the lower part of the inner wall of the outer ring (11). The inner ring (12) has first retaining means in the form of shoulders (121) regularly distributed in the upper part of its outer face.

The push button (20) is composed of a cylindrical wall (21) closed at its upper end by a top wall (22). The push button includes a transfer conduit (23) for transferring the product to be sprayed from the outlet of the valve stem to the outside of the push button. The first end of this transfer conduit is provided with a tip (231) into which the valve stem penetrates when the push button is moved towards the valve in order to dispense the product to be sprayed. The other end (232) opens on the outer face of the push button, either at the cylindrical wall (21) for a jet close to the horizontal direction, or at the level of the top wall (22) for a jet close to the vertical direction. A nozzle can be provided at the end (232) of the transfer conduit opening on the outer face of the cap. The tip (231) is aligned on the axis of symmetry (A).

The push button is provided with second retaining means intended to cooperate with the first retaining means (121) placed on the base ring (10). These second retaining means are constituted, for example, by shoulders (211) regularly distributed in the lower part on the inner face of the cylindrical wall (21). The lower face of the shoulders (121) of the base ring and/or the upper face of the shoulders (211) of the push button are preferably substantially horizontal (perpendicular to the axis of symmetry (A)), so that they can bear on each other to ensure that the push button is retained on the base ring. In contrast, the upper face of the shoulders (121) of the base ring and/or the lower face of the shoulders (211) of the push button are preferably inclined so as to form ramps to facilitate the passage of the shoulders of the button behind those of the base ring when mounting the push button on the base ring.

Figure 6A:
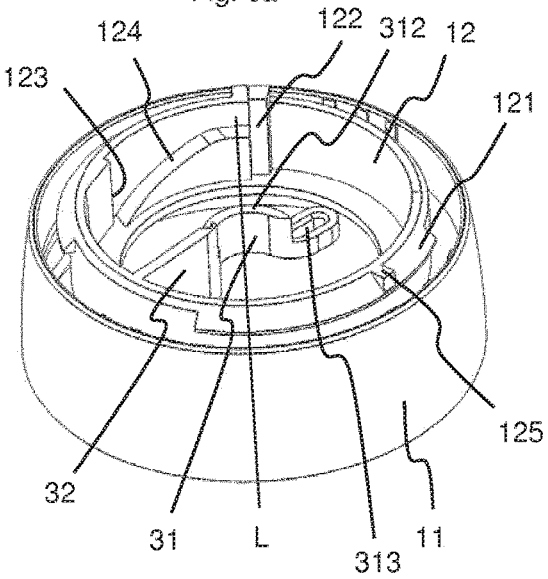
Figure 6B:
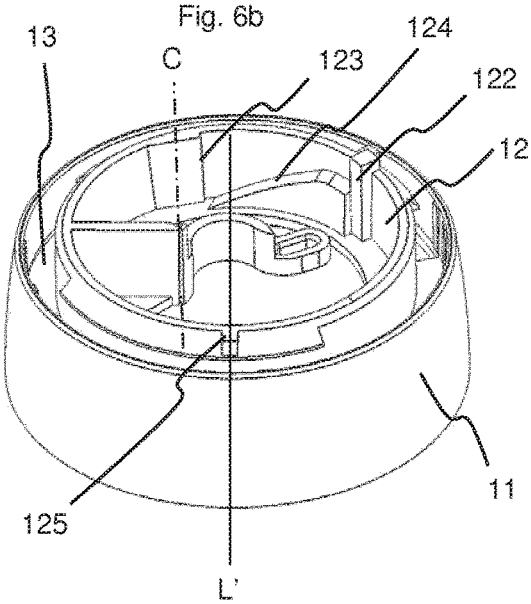

The push button is provided with a support rib (24) oriented radially towards the center of the cylindrical portion (21). This support rib is placed below the second end (232) of the transfer conduit. It extends over a distance sufficient so that its lower edge (241) abuts against the upper edge of the inner annular ring (12) of the base ring. At this location, the inner ring can be reinforced, as shown in FIGS. 6*a* and 6*b*, by an extra thickness (125) for support. However, it is also possible to provide no extra thickness, as in the embodiment of FIGS. 13*a* and 13*b*.

When the push button (20) is mounted on the base ring (21), the shoulders (211) of the push button are placed below the shoulders (121) of the base ring so that the button cannot come out. It can, however, rotate relative to the base ring about the axis of symmetry (A). When it is in the unlocked position, the button can tilt about a horizontal tilting axis (B) passing through the point of contact between the lower edge (241) of the support rib (24) and the upper edge of the inner ring (12) of the base ring. The tilting axis (B) is orthogonal to the general axis of symmetry (A). It is therefore possible to push the button towards the valve to lower the tip (231) towards the valve to actuate it. This tilting axis (B) is shown schematically in FIG. 1.

In order to limit the rotational movement of the push button (20) relative to the base ring (10), there is provided on the inner face of the inner ring (12) a locking stop (122) and an unlocking stop (123). Meanwhile, a finger (25) is placed inside the button so that at the end of the movement path, it comes into contact with one of the two stops (122, 123) of the base ring, thus limiting the rotational movement of the push button relative to the base ring between a locked position when the finger is in abutment against the locking stop (122) and an unlocked position (123) in which it is in abutment against the unlocking stop (123).

Blocking means (30) are provided in the dispensing head to prevent movement of the push button towards the valve when the blocking means are in the blocking position. In the examples presented here, the blocking means are constituted by a blocking member (31) fixed to the inner annular ring (12) via a vertical fixing wall (32). The blocking member (31) is rotatable relative to the base ring about a vertical axis of rotation (C) parallel to the axis of symmetry (A). The axis of rotation (c) is constituted by a hinge, for example a film hinge. In the present example, the blocking member is in the form of a vertical wall curved in a circular arc so as to form a notch (311) in front of its concave face. The blocking member (31) can be moved between a blocking position visible in FIGS. 5*a*/6*a* and 12*a*/13*a* and an unblocking position visible in FIGS. 5*b*/6*b* and 12*b*/13*b*.

Figure 7B:
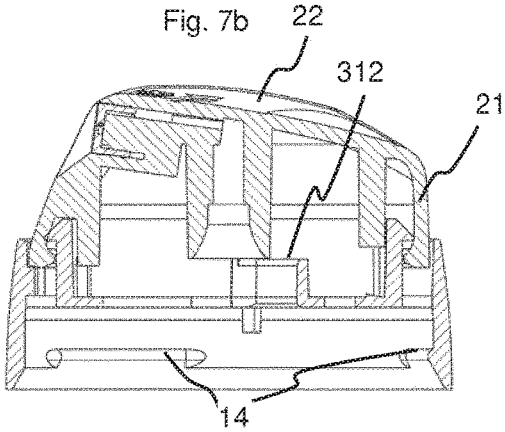

Guiding means are provided to move the blocking member between the blocking position in which the upper edge (312) of the curved wall is in alignment with a portion of the lower edge of the tip (231) of the transfer channel (FIGS. 7*a*/8*a*/9*a*) and the unblocking position in which the blocking member (31) is at a distance from the axis of symmetry (A) to leave the space straight under the tip (231) of the transfer channel free so that the tip can be lowered to the valve stem to actuate it (FIGS. 7*b*/8*b*/9*b*). These guiding means are constituted by, on the one hand, a guide pin (33) fixed to the push button (20), and on the other hand, a guide slot (313) placed at the end of the blocking member opposite the fixing wall (32). When the push button is turned in one direction or the other, the guide pin (33) follows the same movement, driving with it the blocking member (31).

When the push button is in the locked position, the stop finger (25) bears against the locking stop (122), the blocking member (31) is in the blocked position, aligned with at least a portion of the lower edge of the tip (231) of the transfer conduit. If pressure is exerted on the push button in the direction of the valve, the lower edge of the tip (231) abuts against the upper edge (312) of the blocking member: the tip can not reach the stem of the valve. This is the situation shown in FIGS. 7*a*, 8*a* and 9*a*. When the push button is in the unlocked position, the stop finger (25) bears against the unlocking stop (123), the blocking member (31) is in the unblocking position, away from the tip (231), so that there is no obstacle to the movement path of the latter in the direction of the valve stem. If pressure is exerted on the push button in the direction of the valve, the tip encounters no obstacle and can be engaged onto the stem to actuate the valve. In this case, the tip (231) passes in front of the notch (311) of the blocking member. This is the situation presented in FIGS. 7*b*, 8*b* and 9*b*.

Disengagement means are provided for removing the valve stem from the tip (231) of the transfer conduit when the push button is in the unlocked position. These uncoupling means are constituted by a ramp (124) placed between the locking stop (122) and the unlocking stop (123). The further the ramp moves away from the unlocking stop (123) to approach the locking stop (122), the further it deviates from the lower edge of the inner annular ring (12). The width of this ramp is chosen so that the stop finger (25) is aligned with it vertically. In the locked position, the stop finger (25) bears against the locking stop (122) and its lower end (251) is in contact with the top of the ramp (124) while the end (231) of the transfer conduit bears against the blocking member (31). The push button is thus supported at three points: (i) at the support rib (24) whose lower edge (241) bears against the upper edge of the inner ring (12), (ii) at the blocking member (31) on which the lower edge of the tip (231) bears, and (iii) at the stop finger (25) whose lower end (251) is supported on the top of the ramp (124). These three points of support are marked in FIG. 6*a* by the line (L). In the unlocked position, the stop finger (25) bears against the unlocking stop (123), its lower end (251) touches the ramp (124), or comes into contact with it, in its lower part (the closest to the lower edge of the inner ring), only when the push button is fully depressed, with the valve in the open position. In contrast, the support rib (24) is aligned with the support extra thickness (125) when there is one, as in the first embodiment. The alignment between (i) the support extra thickness (125), the axis of symmetry (A) and the bottom of the ramp is marked in FIG. 6*b* by the line (L'). When the push button in the unlocked position is depressed to actuate the valve, which is the lowest position that the push button can take, the tip (231) is engaged onto the stem of the valve. When the pressure exerted on the push button ceases, the valve closes and the stem returns to its high position, bringing with it the push button in an intermediate position, but without disengaging the tip from the stem. By rotating the push button towards the locked position, at some point, the stop finger (25) comes into contact with the ramp (124) which it then follows, lifting the push button away from the valve. The tip (231) is then moved away from the stem. In the locked position, the stop finger has raised the push button sufficiently so that the blocking member can be inserted between the tip (231) and the stem of the valve. The push button is in the highest position, the stop finger (25) bearing against the top of the ramp (124).

Figure 5A:
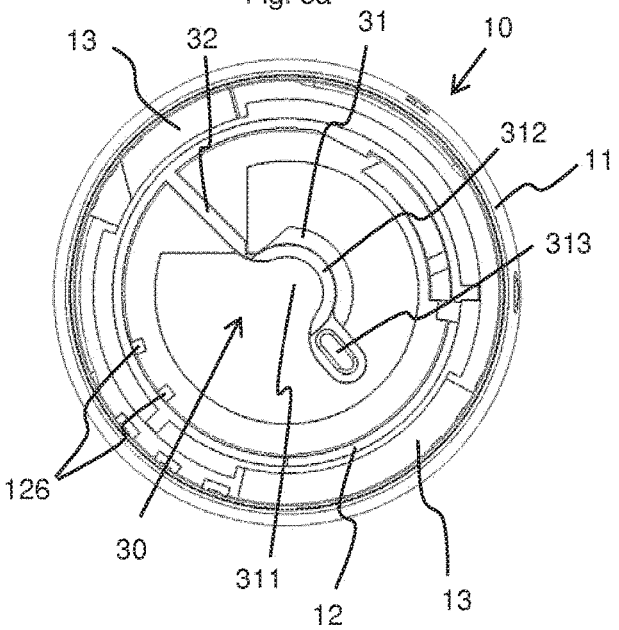
Figure 5B:
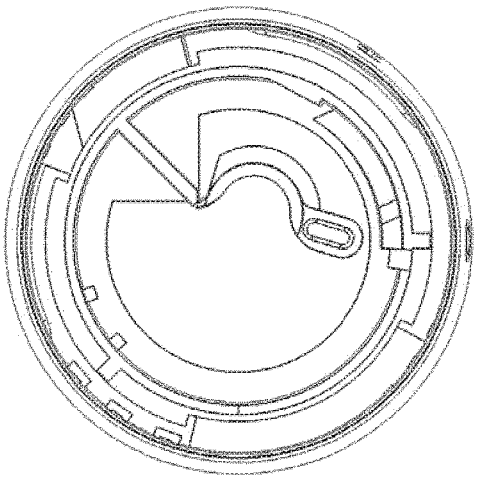

It is possible to provide on the inner wall of the inner ring (12) of the base ring one or two extra thicknesses (126) and on the support wall (24) a vertical tab (242) oriented downwards. FIG. 12*a* shows an extra thickness, FIG. 5*a* shows two. The tab (242) is placed on the support wall so that when the push button moves from the locked position to the unlocked position or vice versa, the tab comes knocking against the one or more thicknesses (126), thus producing a click or two close clicks, indicating that the push button is moving from one position to another. It would be possible to place the extra thicknesses so that the clicks are heard only at the beginning and at the end of the rotation. It would also be possible to provide no extra thickness.

In the examples presented here, the base ring is intended to be fixed on the aerosol container, while the push button is rotatable relative to the base ring and the aerosol container. It could also have been provided that the base ring is also mobile relative to the aerosol container.

Rather than putting the pin (33) in the bottom of the push button (20) and the slot (313) on the blocking member (30), it could be provided to place the pin on the blocking member, oriented towards the bottom of the push button, and to make a guide groove in the bottom of the push button to guide the pin during the rotation of the push button relative to the base ring. The guide groove must be deep enough not to hinder the rotational movement of the push button relative to the base ring when actuating the valve. Another solution would be to provide the push button with two walls placed on either side of the free end of the blocking member so that the rotation of the push button relative to the base ring in one direction causes a corresponding displacement of the two walls, one of which would come to abut against the end of the blocking member and then drive it in rotation towards one of the end positions. By turning the push button in the other direction, it would be the other wall that would come to abut against the blocking member and then drive it towards the other end position.

In all cases, it is the movement of the push button relative to the base ring that causes the pivoting of the blocking member between the two end positions.

LIST OF REFERENCES

10 Base ring
- 11 Outer annular ring
- 12 Inner annular ring
  - 121 First retaining means
  - 122 Locking stop
  - 123 Unlocking stop
  - 124 Ramp
  - 125 Support extra thicknesses
  - 126 Audible extra thicknesses
- 13 Connecting walls
- 14 Fixing means (bulges)

20 Push button
- 21 Cylindrical wall
  - 211 Second retaining means
- 22 Top wall
- 23 Transfer conduit
  - 231 Tip
  - 232 Outlet end
- 24 Support rib
  - 241 Lower edge
  - 242 Tab cooperating with the audible extra thicknesses
- 25 Stop finger
  - 251 Bottom end of the finger

30 Blocking means
- 31 Blocking member
  - 311 Notch
  - 312 Upper edge
  - 313 Guide slot
- 32 Fixing wall
- 33 Guide pin A Axis of symmetry B Tilting axis of the push button relative to the base ring C Axis of rotation of the blocking member relative to the base ring L Alignment of the three support points in locked position L' Alignment support point/axis of symmetry/bottom of ramp in unlocked position

The invention claimed is:

1. Dispensing head for an aerosol container provided with a valve equipped with a valve stem, the dispensing head comprising a base ring, a transfer conduit provided with a tip intended to cooperate with a stem of a valve when the dispensing head is mounted on an aerosol container equipped with such a valve, a push button rotatable relative to the base ring about an axis of rotation passing through the tip between a locked position and an unlocked position, and blocking means movable between a blocking position in which the tip cannot cooperate with the valve stem and an unblocking position in which the tip can cooperate with the valve stem to open the valve, the push button being movable relative to the base ring between a high position in which the tip of the transfer conduit is at a distance from the valve stem and a low position in which the tip cooperates with the stem to open the valve, wherein the blocking means comprise a blocking member mobile relative to the base ring and pivotable between a blocking position and an unblocking position, the blocking member being provided with a bearing surface, wherein the bearing surface is placed in the movement path of the tip of the transfer conduit towards the valve stem when the blocking member is in the blocking position, and wherein the bearing surface is outside the movement path of the tip towards the valve stem when the blocking member is in the unblocking position, and guiding means for placing the blocking member in the blocking position when the push button is in the locked position and for placing the blocking member in the unblocking position when the push button is in the unlocked position.

2. Dispensing head according to claim 1, wherein the guiding means are constituted by a guide pin and a guide slot into which the free end of the guide pin penetrates, one of the guide slot and the guide pin being fixed in the push button while the other of the guide slot and the guide pin is fixed on the blocking member.

3. Dispensing head according to claim 1, wherein the blocking member is constituted by a vertical wall having a notch, the upper edge of the vertical wall constituting the bearing surface.

4. Dispensing head according to claim 1, wherein the transfer conduit is an integral part of the push button.

5. Dispensing head according to claim 1, wherein the blocking member and the guiding means are designed so that a rotation of the push button relative to the base ring causes a pivoting of the blocking member between the blocking position and the unblocking position.

6. Dispensing head according to claim 1, wherein the blocking member is fixed to the base ring via a hinge forming another axis of rotation parallel to the axis of rotation of the push button relative to the base ring.

7. Dispensing head according to claim 6, wherein the hinge is fixed to a fixing wall forming an integral part of the base ring.

8. Dispensing head according to claim 1, wherein disengagement means are provided for disengaging the tip from the stem of a valve when the button is moved from the unlocked position to the locked position.

9. Dispensing head according to claim 1, wherein stops are provided on the base ring or on the push button, which stops cooperate with a stop finger placed on the push button or on the base ring to limit the rotational movement of the push button relative to the base ring between the locked position and the unlocked position.

10. Dispensing head according to claim 1, wherein audible information means are provided for emitting one or more sounds when the push button moves from the locked position to the unlocked position or vice versa.

11. Dispensing head according to claim 10, wherein the sounds include one or more clicks.

12. Dispensing head according to claim 2, wherein the guide pin is fixed in the push button while the guide slot is fixed on the blocking member.

13. Dispensing head according to claim 6, wherein the hinge is a film hinge.

14. Dispensing head according to claim 2, wherein the blocking member is constituted by a vertical wall having a notch, the upper edge of the vertical wall constituting the bearing surface.

15. Dispensing head according to claim 2, wherein the transfer conduit is an integral part of the push button.

16. Dispensing head according to claim 3, wherein the transfer conduit is an integral part of the push button.

17. Dispensing head according to claim 14, wherein the transfer conduit is an integral part of the push button.

18. Dispensing head according to claim 2, wherein the blocking member and the guiding means are designed so that a rotation of the push button relative to the base ring causes a pivoting of the blocking member between the blocking position and the unblocking position.

19. Dispensing head according to claim 3, wherein the blocking member and the guiding means are designed so that a rotation of the push button relative to the base ring causes a pivoting of the blocking member between the blocking position and the unblocking position.

20. Dispensing head for an aerosol container provided with a valve equipped with a valve stem, the dispensing head comprising a base ring, a transfer conduit provided with a tip intended to cooperate with a stem of a valve when the dispensing head is mounted on an aerosol container equipped with such a valve, a push button rotatable relative to the base ring about an axis of rotation passing through the tip between a locked position and an unlocked position, and blocking means movable between a blocking position in which the tip cannot cooperate with the valve stem and an unblocking position in which the tip can cooperate with the valve stem to open the valve, the push button being movable relative to the base ring between a high position in which the tip of the transfer conduit is at a distance from the valve stem and a low position in which the tip cooperates with the stem to open the valve, wherein the blocking means comprise a blocking member pivotable between a blocking position and an unblocking position, the blocking member being provided with a bearing surface, wherein the bearing surface is placed in the movement path of the tip of the transfer conduit towards the valve stem when the blocking member is in the blocking position, and wherein the bearing surface is outside the movement path of the tip towards the valve stem when the blocking member is in the unblocking position, and guiding means for placing the blocking member in the blocking position when the push button is in the locked position and for placing the blocking member in the unblocking position when the push button is in the unlocked position, wherein the guiding means are constituted by a guide pin and a guide slot into which the free end of the guide pin penetrates, one of the guide slot and the guide pin being fixed in the push button while the other of the guide slot and the guide pin is fixed on the blocking member.

* * * * *